US007048027B1

(12) United States Patent
Abita

(10) Patent No.: US 7,048,027 B1
(45) Date of Patent: May 23, 2006

(54) ARCUATE SHADE

(76) Inventor: Charles J. Abita, 52261 Marcello La., Macomb, MI (US) 48042

( * ) Notice: Subject to any disclaimer, the term of this patent is extended or adjusted under 35 U.S.C. 154(b) by 0 days.

(21) Appl. No.: 10/899,232

(22) Filed: Jul. 26, 2004

(51) Int. Cl.
*E06B 9/06* (2006.01)

(52) U.S. Cl. ..... 160/84.07; 160/134

(58) Field of Classification Search ..... 160/84.07, 160/134, 330, 38, 178.2 R
See application file for complete search history.

(56) References Cited

U.S. PATENT DOCUMENTS

| | | | | | |
|---|---|---|---|---|---|
| 1,609,877 | A | * | 12/1926 | Kendall | 160/84.07 |
| 3,649,069 | A | * | 3/1972 | Zip | 296/97.7 |
| 4,383,658 | A | | 5/1983 | Morita et al. | 242/107 |
| 4,407,539 | A | | 10/1983 | Asp | 292/338 |
| 4,776,380 | A | * | 10/1988 | Lester | 160/134 |
| 4,934,436 | A | | 6/1990 | Schnebly | 160/84.1 |
| 5,002,112 | A | * | 3/1991 | Schnebly et al. | 160/84.07 |
| 5,010,939 | A | | 4/1991 | King | 160/84.1 |
| 5,050,661 | A | | 9/1991 | Sikkema et al. | 160/84.1 |
| 5,117,889 | A | | 6/1992 | Coe | 160/134 |
| 5,168,912 | A | * | 12/1992 | Jelic et al. | 160/84.07 |
| 5,183,092 | A | | 2/1993 | Jelic | 160/84.1 |
| 5,471,789 | A | | 12/1995 | Faircloth | 49/74.1 |
| 5,584,329 | A | | 12/1996 | Thomas | 160/134 |
| 5,660,220 | A | | 8/1997 | Ruan | 160/84.07 |
| 5,662,153 | A | | 9/1997 | Rosenblatt | 160/84.07 |
| 5,765,619 | A | | 6/1998 | Arnold | 160/84.07 |
| 5,794,680 | A | | 8/1998 | Xue | 160/84.07 |
| 5,857,493 | A | | 1/1999 | Matz | 138/110 |
| 6,029,733 | A | * | 2/2000 | Xue | 160/84.07 |
| 6,145,569 | A | * | 11/2000 | Shaw et al. | 160/84.07 |
| 6,192,967 | B1 | * | 2/2001 | Huang | 160/370.23 |
| 6,460,294 | B1 | | 10/2002 | Harkins | 49/345 |
| 6,585,027 | B1 | | 7/2003 | Roberts | 160/349.1 |
| 6,651,722 | B1 | | 11/2003 | Fleishman et al. | 160/168 |
| 6,820,674 | B1 | * | 11/2004 | Abita et al. | 160/84.07 |

* cited by examiner

*Primary Examiner*—David Purol
(74) *Attorney, Agent, or Firm*—Young & Basile, P.C.

(57) ABSTRACT

An apparatus and method for selectively positioning a shade along an arcuate path to cover at least a portion of an arched window and to correctly align the shade within a window frame to prevent gaps or over-extensions of the shade with respect to the window. The apparatus includes a linear rail for securing the shade, an actuating device for extending and retracting single or dual shades simultaneously and an alignment device to correctly align the outer peripheral edges of the shade to the peripheral edges of the window. The actuating device can include a spring-loaded cord system to simultaneously rotated arms carrying portions of the shade. The actuating device can also include a gear and hinge device. The alignment device includes an arcuate ramp that corresponds to the configuration of the window for eliminating gaps between the shade and the outer periphery of the window when the shade is in a closed position. The alignment device can also include a linear guide to extend or retract the linear edges of the shade. The alignment device also includes a spring mechanism to eliminate gaps between dual shades when the shade is in a closed position.

33 Claims, 10 Drawing Sheets

ARCUATE SHADE

FIELD OF THE INVENTION

The present invention relates to an apparatus and method for positioning a shade relative to a window.

BACKGROUND OF THE INVENTION

Arched or semicircular windows are well known. Arched windows can be positioned in a door, above a door or positioned above a rectangular window. It can be desirable to position a shade to at least partially cover an arched window. A shade or blind positionable adjacent an arched window can be moveable between an extended position and a retracted position. In the retracted position, the shade can define one or more folds.

When positioned adjacent an arched window, the shade can be moveable along an arcuate path adjacent the arched window to cover at least a portion of the arched window. However, known devices for moving a shade or blind along an arcuate path to cover at least a portion of an arched window are not as efficient as desired. In particular, most shades for arched windows do not provide complete closure, but instead create uneven gapping at certain arcuate portions of the window. The gapping generally occurs at the lower arcuate edges and at the top of the arch. The gaps are caused because the radial center of the window shade installed on the window is different than the radial center of the actual window. The offset is usually caused by the location of the hardware of the shade. Compensating for the offset of the radial center can be difficult. Further, known devices are too complicated and costly or too ineffective and unreliable to accurately position the shade along the arcuate path without having open gaps between the edge of the shade and the periphery of the window as desired.

Another disadvantage of current arcuate shades is that the shade for arched windows are formed by split half shades, wherein each split half shade is manipulated independently to open or cover its own half of the arched window. For aesthetic reasons and for efficiency, it is preferable that a single actuation member expands and retracts both split half shades in unison.

SUMMARY OF THE INVENTION

It is the intent of this invention to address the aforementioned concerns. In one aspect of the invention, there is an apparatus for positioning an arcuate shade along an arcuate path of a window frame, the arcuate shade has at least one inner and outer arcuate edge and at least one upper and lower linear edge. The apparatus includes a member engageable with the shade, an actuation means for moving the member along the arcuate path and alignment means for expanding and retracting at least certain edges of the shade for eliminating uneven gapping between the shade and the arcuate path of the window.

In another aspect of the invention, the alignment means may include an arcuate rail for guiding at least one inner arcuate edge of the shade as the shade is opened and closed. In another aspect of the invention, the alignment includes a linear guide for movement of at least one of the lower linear edges of the shade toward an outer arcuate edge of the window.

In yet another aspect of the invention, the actuation means may include a cord communicating and actuating the member for rotatable movement as well as communicating and reciprocally moving the linear guide.

Further, in another aspect of the invention, the actuation means may include a knob communicating with the member and also with a plunger mechanism. The plunger mechanism reciprocally moves the linear guide parallel to the linear rail.

In still another aspect of the invention, the actuation means includes a knob communicating with a gear and hinge device for rotating a pair of members.

Other applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DETAILED DESCRIPTION OF THE PREFERRED EMBODIMENT

Figure 6:
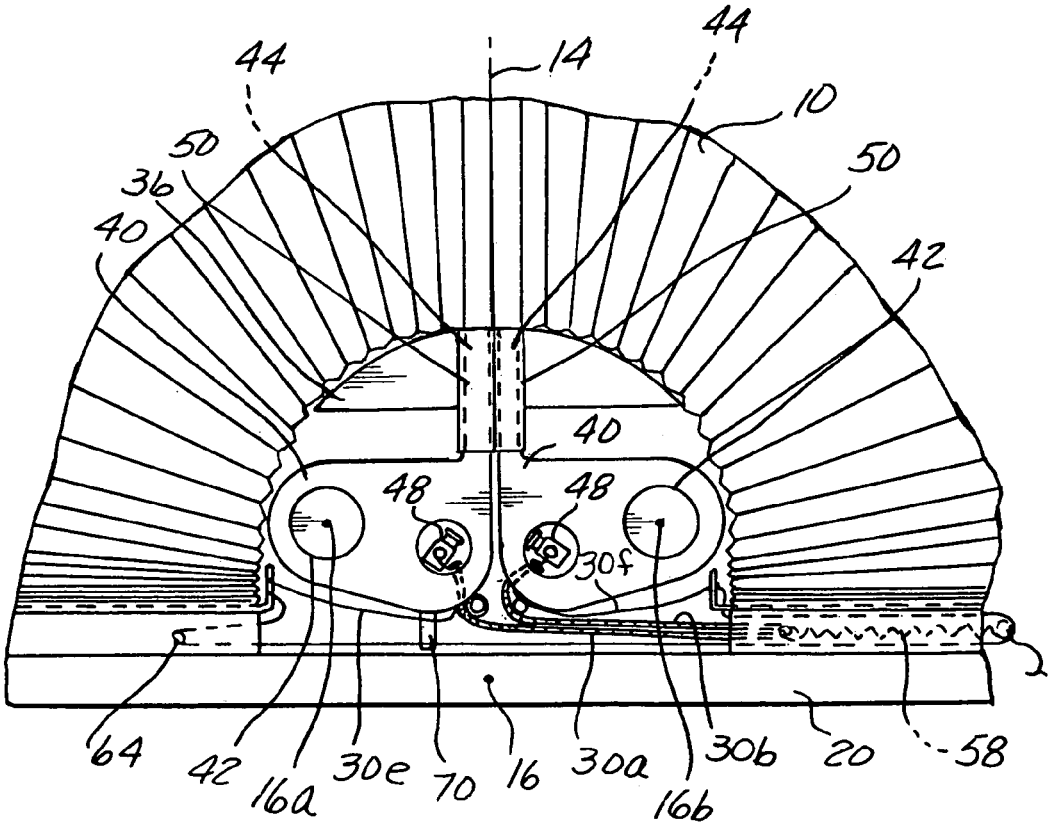
FIG. 6 is an elevational view of portions of the alignment means when the window shade is in an extended position of substantially ninety degrees showing the relationship of certain features.
Figure 12:
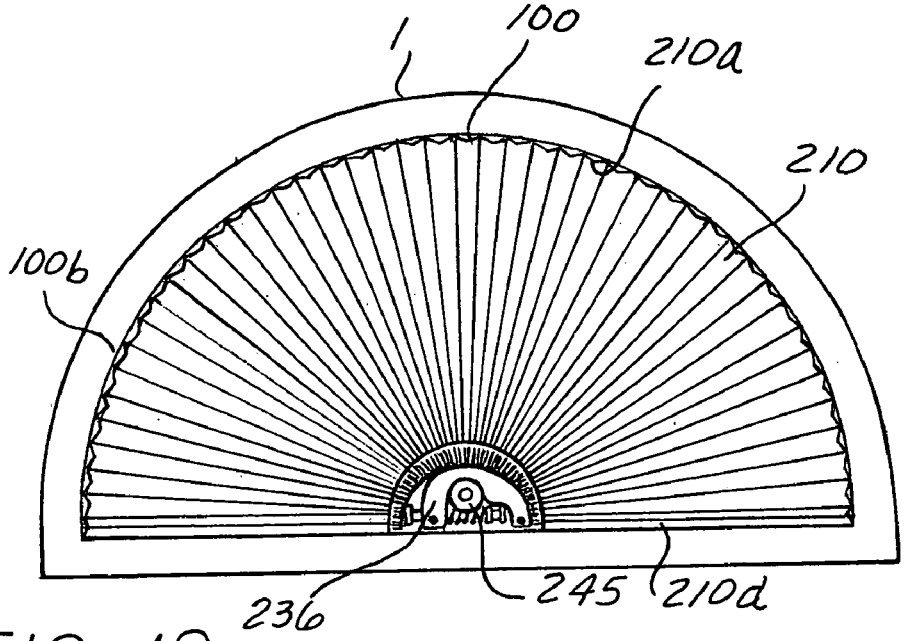
FIG. 12 is an elevational view of a window shade according to the third embodiment of the present invention wherein the shade extends substantially one hundred and eighty degrees.

Referring now to FIGS. 1–6, a window shade 10 can be movable along an arcuate path 12. The shade 10 can be sized to extend from a retracted position to an extended position. The arcuate path 12 can extend substantially 90° as shown in FIGS. 4*a* and 6 and the extended position of the shade 10 can correspond to a position of the vertical axis 14. In the alternative embodiment, the arcuate path 12 can extend substantially 180°, as shown in FIG. 12. The retracted position of the shade 10 in the first embodiment can correspond to 0° along the arcuate path and define a one or more folds as shown in FIG. 4B. The arcuate path 12 defines a radius with respect to two centers of rotation 16*a*, 16*b*. However, although the radial center of the window is shown at 16, a point below a linear rail 20. The radial center of each shade is shown approximately at points 16*a*, 16*b*. Because of the offset of the radial center between the window at 16 and the shade at 16*a*, 16*b*, gapping between the shade and the periphery of the window can occur. Further, although the window frame 1 is purported to outline a semicircle of a window, in many cases the window is not an exact semicircle. The gap between the center of rotation and the radial center as well as any irregularity in the window or window frame results in open gaps formed between portions of the outer arcuate peripheral edge 10*a* of the shade and the arcuate peripheral edge 100*a* of the window 100.

Referring to FIGS. 1–6, the apparatus for positioning the shade along an arcuate path of a window 100 includes a linear rail 20, which can be a continuous rail 20, for supporting lower linear edges 10*b* of the shade 10. Centrally located on the linear rail 20 are actuating means and alignment means for the shade 10. The actuating means and alignment means are connected to the linear rail by a bracket 22. The bracket 22 includes a pair of spaced, vertical flanges 24. The bracket 22 can also be separate vertical flanges 24 screw-mounted into the sides of the rail 20. Each vertical flange 24 includes a pair of spaced apertures 26. The apertures 26 on each vertical flange 24 are parallel to each other and are also parallel to the corresponding apertures 26 on the other vertical flange 24.

The actuating means includes a pair of spaced pins 28*a, b* located between the pair of apertures 26. Each pin 28*a, b* is connected to each vertical flange 24 at opposing ends. The pair of pins 28*a, b* provide cord guides as will be discussed hereinafter. At least one of the pins 28*a, b*, and preferably the pin 28*a*, spaced furthest away from the end of the pulley cord 30, has a roller 32*a*, 32*b* thereon. The roller 32*a, b* is rotatable with respect on the pin 28*a,b*. respectively.

Figure 1:
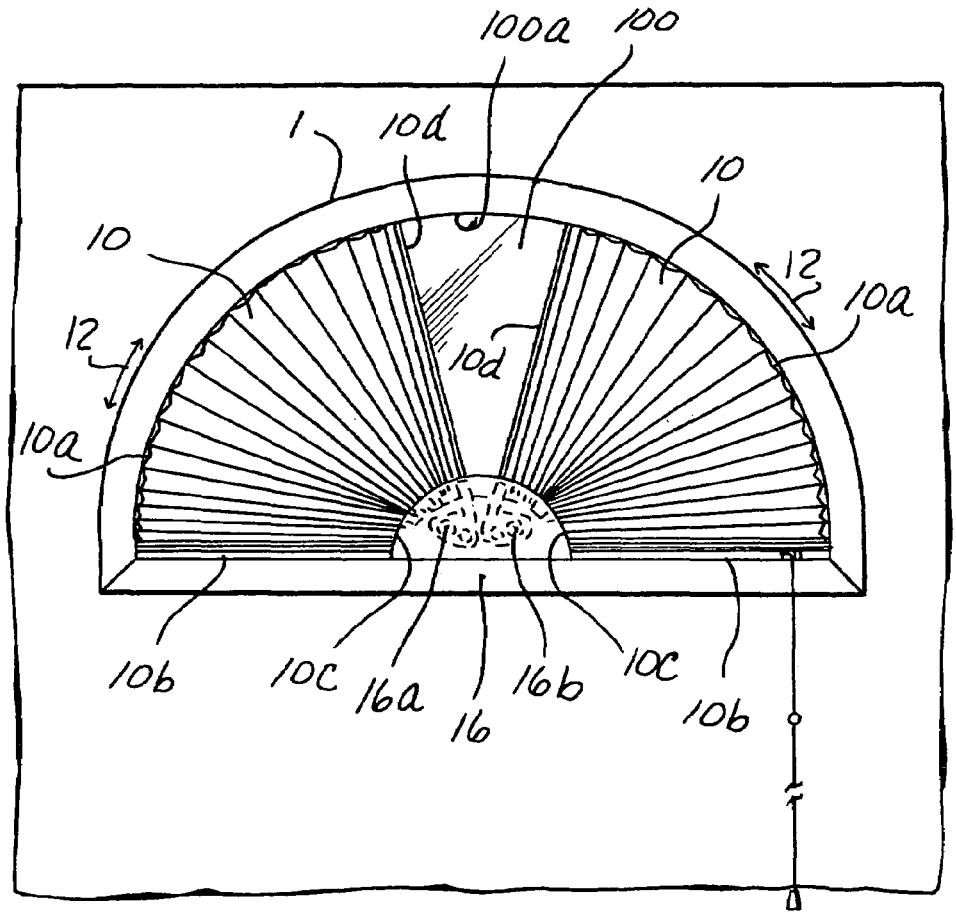
FIG. 1 is an elevational view of a window shade according to a first embodiment of the present invention and positioned within a window frame.
Figure 2:
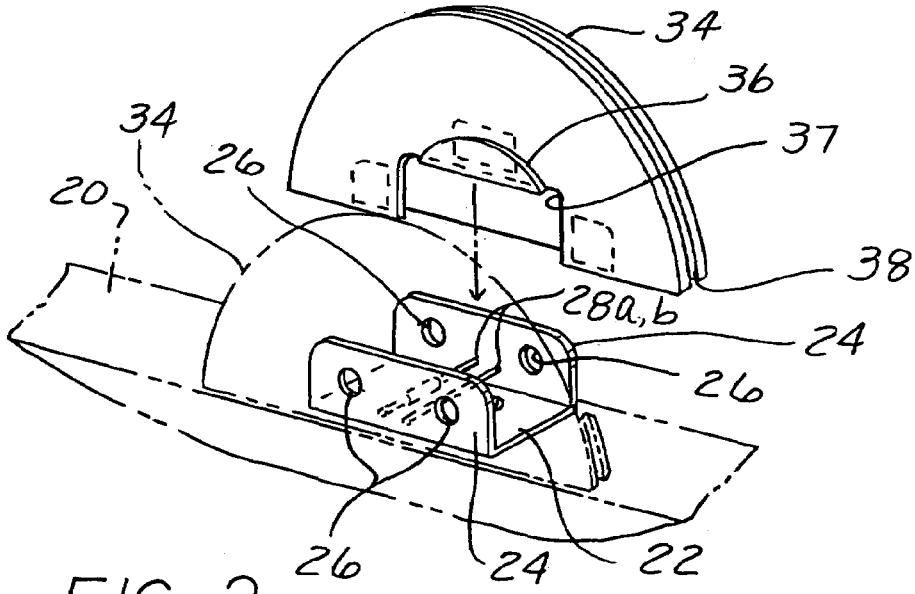
FIG. 2 is a perspective view of bracket member for the window shade in FIG. 1.

Cover panels 34 are configured to slide over each vertical flange 24. The cover panels 34 provide a decorative shield to hide the shade mechanisms for the actuating means and alignment means as well as providing a support for a portion of the alignment means, and in particular, an arcuate rail 36 which guides the lower flexible edge 10*c* of the shade 10. The cover panels 34 also maintain the shade 10 parallel to the window 100. The arcuate rail 36 is positioned directly over the cutout 37 in the cover panels 34 and may be integrally formed on the cover panel 34. Each cover panel 34 has an outer configuration for sliding over one of the vertical flanges 24 and for providing a cut out 37 for receiving a portion of the vertical flange 24 therein. The cover panel 34 further includes a groove 38 along a lower edge for receiving a portion of the vertical flange 24. In FIG. 2, a perspective view of one of the cover panels 34 is shown. A mirror image of another cover panel 34 is shown in phantom.

Figure 3:
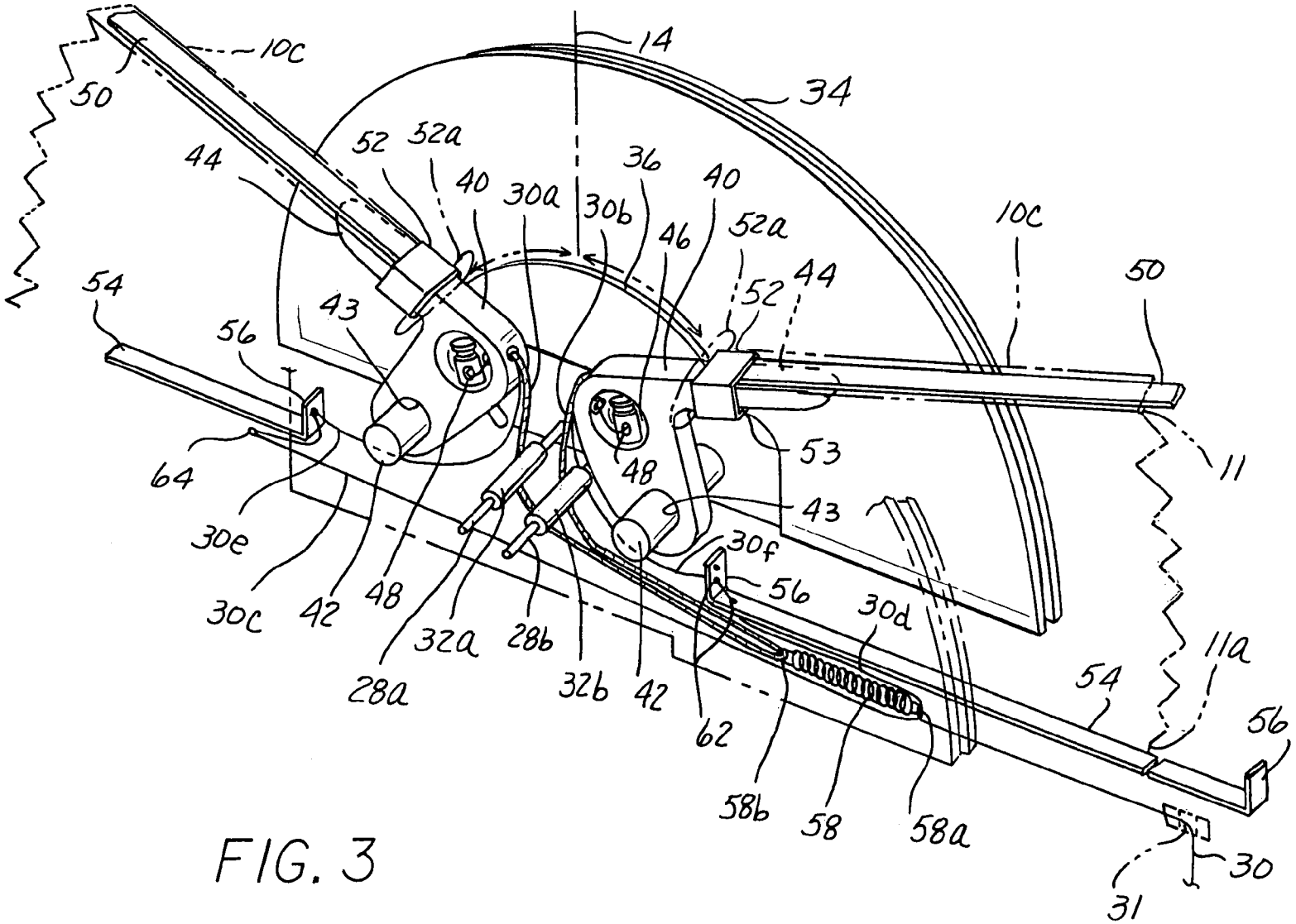
FIG. 3 is a perspective view of a first embodiment of an alignment means for the window shade shown in FIG. 1.

Rotational movement of the shade 10 relative to the linear rail 20 is provided by a pair of rotatable arms 40. The rotatable arms 40 are connected to the bracket 22 or flanges 24 by means of pins 42 inserted through apertures 43 in each rotatable arm 40 as well as the apertures 26 in the flanges 24 of the bracket 22. Each rotatable arm 40 further includes a guide finger 44 connected to or integrally formed with each rotatable arm 40. Each rotatable arm 40 also includes a central through aperture 46 having means for connecting and securing an end of the pulley cord 30 thereon. The means for securing the end of the pulley cord 30 also can include a conventional means for adjusting the tension on the cord 30. The adjustment means is shown in FIG. 3 at 48.

Figure 4A:
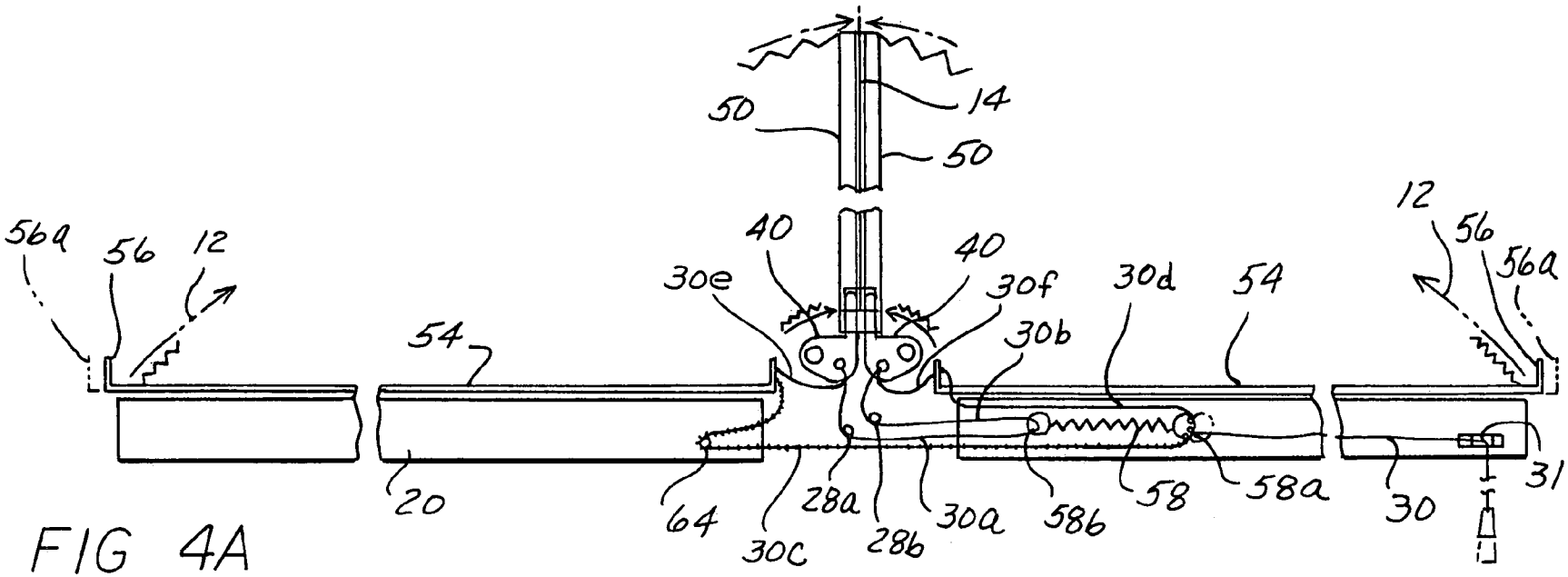
FIGS. 4A and 4B are schematic views showing the alignment means when the window shade is in retracted and extended positions, respectively.

The actuating means includes the cord 30 which actuates both rotatable arms 40 simultaneously. Cord 30 communicates with cord segments 30*a* and 30*b* via spring 58. Cord 30 terminates and is connected to one end 58*a* of spring 58. Cord segments 30*a* and 30*b* are connected to the other end 58*b* of spring 58. The cord segments 30*a*, 30*b* may be separate cords, each connected to end 58*b* of the spring or the cord segment 30*a*, 30*b* may be one continuous cord looped through the end 58*b* of spring 58, allowing for self adjustments. Each other end of segments 30*a* and 30*b* of cord 30 extend separately into and are secured to the rotating arms 40. The tension on the cord segments 30*a* and 30*b*, in relationship to the rotating arms 40, could be adjusted by adjustment pins. When cord 30 is pulled downwardly to actuate extension of the shade 10, the tension on segments 30*a* and 30*b* force the rotatable arms 40 to rotate simultaneously to extending the shade 10 to its desired position. Cord segment 30*a* is routed under pin 28*a* and against roller 32*a* to provide smooth movement of cord 30*a* and provide leverage to rotate rotatable arm 40. Cord segment 30*b* is routed around pin 28*b* and against roller 32*b* to provide leverage to rotate rotatable arm 40. The location of the pins 28*a, b* are to allow the linear members 50 to meet at the 90° position. Each pin 28*a*, 28*b* must be located inboard of their respective rotating arms 40 when the linear members 50 are in the 90° position as shown in FIG. 4A. The shade 10 can be locked in any position by the conventional cord lock 31 currently used in the industry.

A linear member 50 is attached to the length of the upper linear edge 10*d* of each shade 10. The linear member 50, as shown in FIG. 3, may be inserted into one of the uppermost honeycomb cells 11 formed by the shade 10. Snugly inserted into upper honeycomb cell 11 is a cuff member 52 for free reciprocal movement over linear member 50. The cuff member 52 is positioned adjacent the inner radial edge 10*c* of the shade 10. The cuff member 52 has a polygon or oval shape with a center aperture 53 for receiving the linear member 50. The center aperture 53 of the cuff member 52 is slightly larger than the periphery of the linear member 50 so that the cuff member 52 can freely move along the length of the linear member 50. As the shade 10 is extended and retracted, the cuff member 52 has flanges 52*a* on the lower edge that rides along the arcuate rail 36 and leads the inner radial edge 10*c* of the shade 10 to force the shade 10 to conform to a particular path, and not fall as a result of gravity as the shade is being extended. Therefore, the cuff member 52 coordinates with the arcuate rail 36 to align the shade 10 relative to the window 100 to minimize or eliminate gaps between the outer radial edge 10*a* of the shade 10 and purchasing of the window or the window frame 100.

The alignment means may also include a linear guide 54 parallel to the linear rail 20 and positioned in the linear rail 20. The linear guide 54 is a slidable metal or plastic strip having vertically extending edges 56 at each end. The linear guide 54 is inserted into one of the lowermost honeycomb cells 11*a* formed by the shade 10. The linear guide 54 slides relative to the linear rail 20. The linear guide 54 has a length slightly larger than the length of the lower linear edge 10*b* of the shade 10. The lower linear edge 10*b* of the shade 10 is positioned between the vertical extending edges 56 of the linear guide 54 so that the lower linear edge 10*b* of the shade 10 moves with the sliding movement of the linear guide 54. The linear guide 54 returns the lower linear edge 10*b* of the shade in place. In the embodiment shown in FIGS. 1–6, each linear guide 54 communicates with the cord 30 via segments 30*c*, 30*d*, 30*e* and 30*f* and is actuated for movement by means of a spring 58 as will be discussed hereinafter.

Figure 4B:
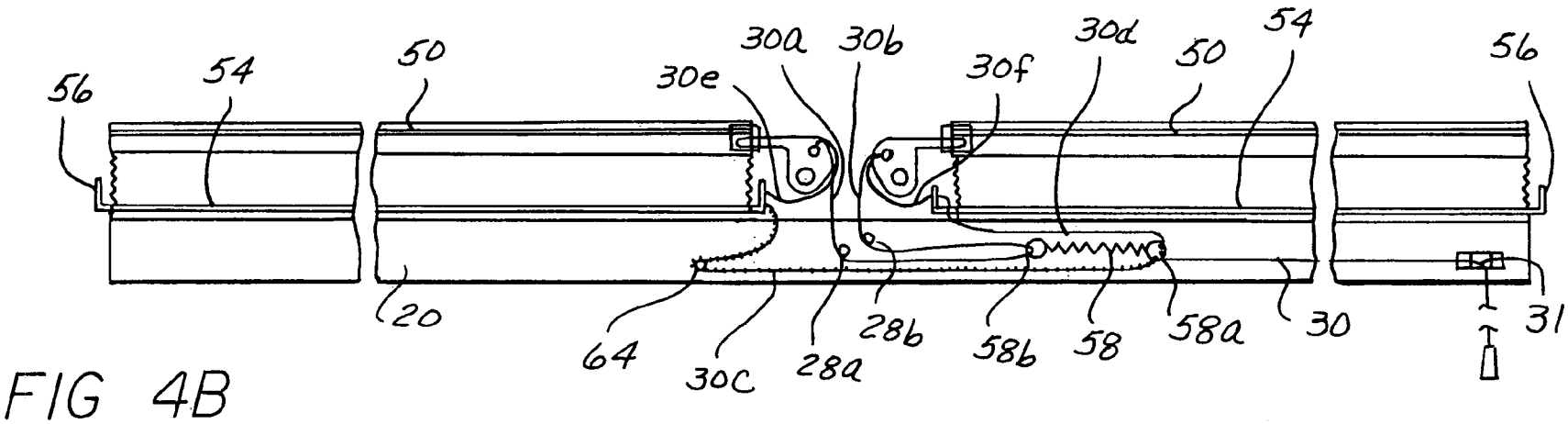
Figure 5:
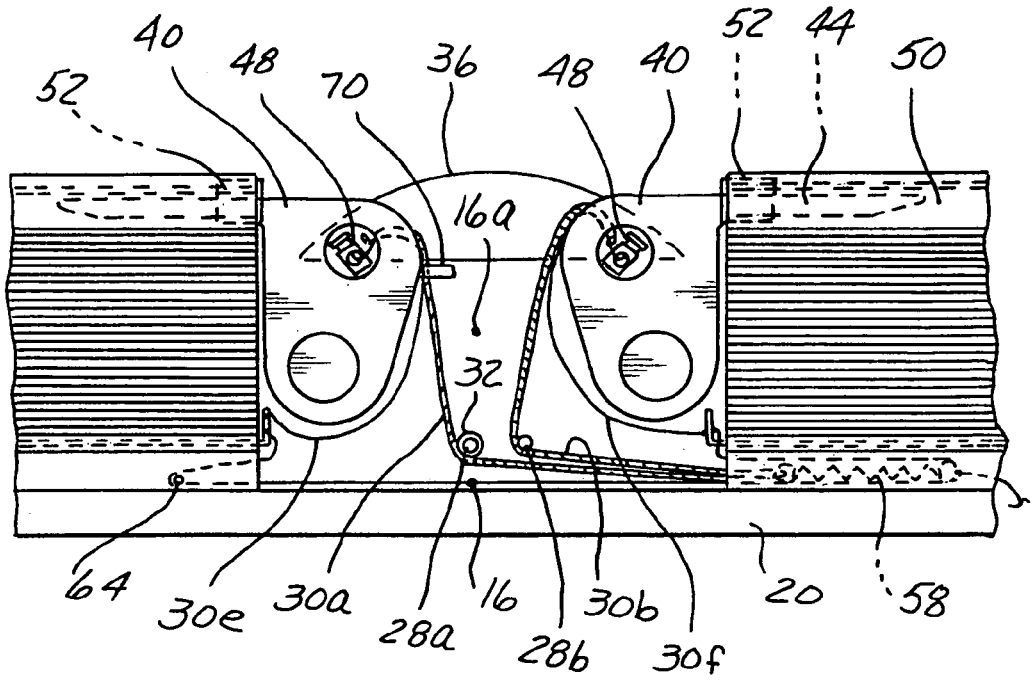
FIG. 5 is an elevational view of portions of the alignment means when the window shade is in a retracted position showing the relationship of certain features.

Cord segment 30*c* and 30*d* interact with the tension on the cord 30 to slide the linear guide 54 into the extended position as shown in FIG. 4*a*. One end of each of cord segment 30*c* and 30*d* is connected to end 58*a* of spring 58. An opposing end of each cord segment 30*c* and 30*d* is connected to one of the interior vertical extending edges 56. As shown in FIG. 3, a small apertures 62 may be drilled through the linear guide 54 to provide proper routing for connection of cord segment 30*d* to the vertical extending edge 56. Cord segment 30*c* is routed from the outside surface of interior vertical extending edge 56 and then around a roller pin 64 spaced outwardly from the center of rotation, before connection to end 58*a* of spring 58. The roller pin 64 facilitates the correct outward movement of linear guide 54 by the tension on cord segment 30*c*. When cord 30 is vertically downwardly pulled, the spring 58 expands which pulls cord segments 30*c*, and 30 *d* and this pulls the outer vertical extensions 56 of the linear guides 54 outwardly, as shown in phantom in FIG. 4*a* at 56*a*. When the shade 10 is locked by conventional methods, the linear members 56 are held in the extended position. When tension is released on cord 30 and the shade 10 is retracted, cord segments 30*e* and 30*f* work in concert with the rotating arms 40 to retract the slidable linear guide 54. As seen in FIGS. 3, 4*a* and 4*b*, one end of cord segments 30*e* and 30*f* are connected to the outer surface of each of the inner vertical extending edges 56 and the opposing end is connected to one of the adjustment pins 48. The tension on the cord segments 30*e* and 30*f*, in relationship to the rotating arms 40, can be adjusted by adjustment pins 48.

To prevent over extension of the shade 10, at least one of the rotating arms 40 has a stop peg 70 attached at a predetermined location along the outside surface of the arm 40. When the stop peg 70 contacts the linear rail 20, further rotation of the arms is prohibited. FIG. 6 shows the stop peg 70 in contact with the linear rail 20.

The spring 58 provides another advantage which includes providing of a means for eliminating any gap between the dual shades when in a closed position. In particular, when the cord 30 is pulled to close the shade 10, spring 58 extends and the pair of upper linear edges 10*d* of the shade contact each other. If another extra downward pull is placed on the cord 30, the spring 58 overextends forcing the upper linear edges 50 of the shade 10 to maintain contact with each other. When the cord 30 is engaged to the locked position using the convention lock system 31, the cord 30 retracts slightly toward the spring 58. However, the spring 58 maintains some of it extension translating to tension on cords 30*a*, 30*b* to maintain the pair of linear members 50 and the upper linear edges 10*d* of the shade 10 in contact with each other to eliminate any gapping between the upper linear edges 10*d* of the shade.

Figure 7:
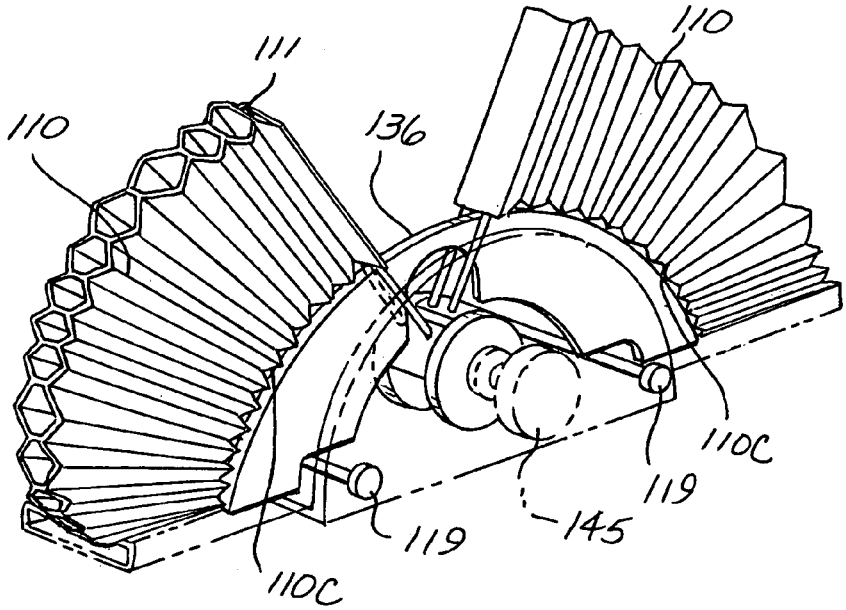
FIG. 7 is a perspective view of a portion of a window shade according to a second embodiment of the present invention.
Figure 8:
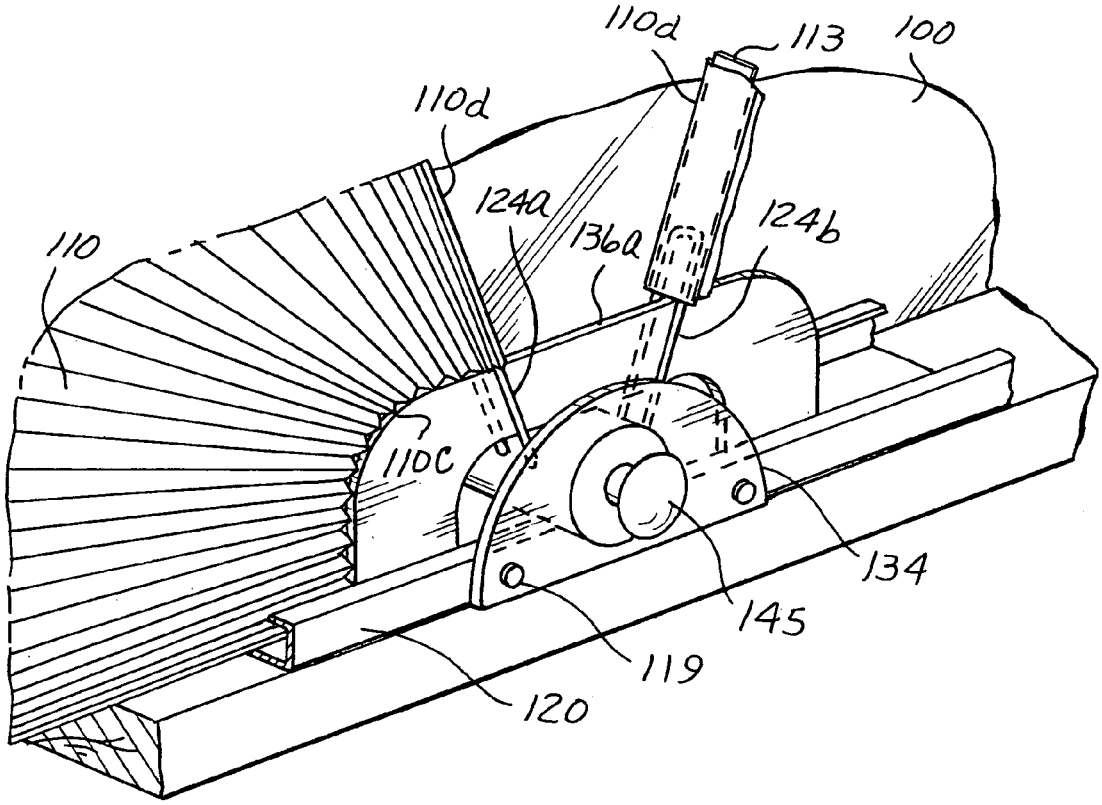
FIG. 8 is a perspective view of a portion of the window shade according to the second embodiment and configured for fitting an eyebrow-shaped, arched window.
Figure 9:
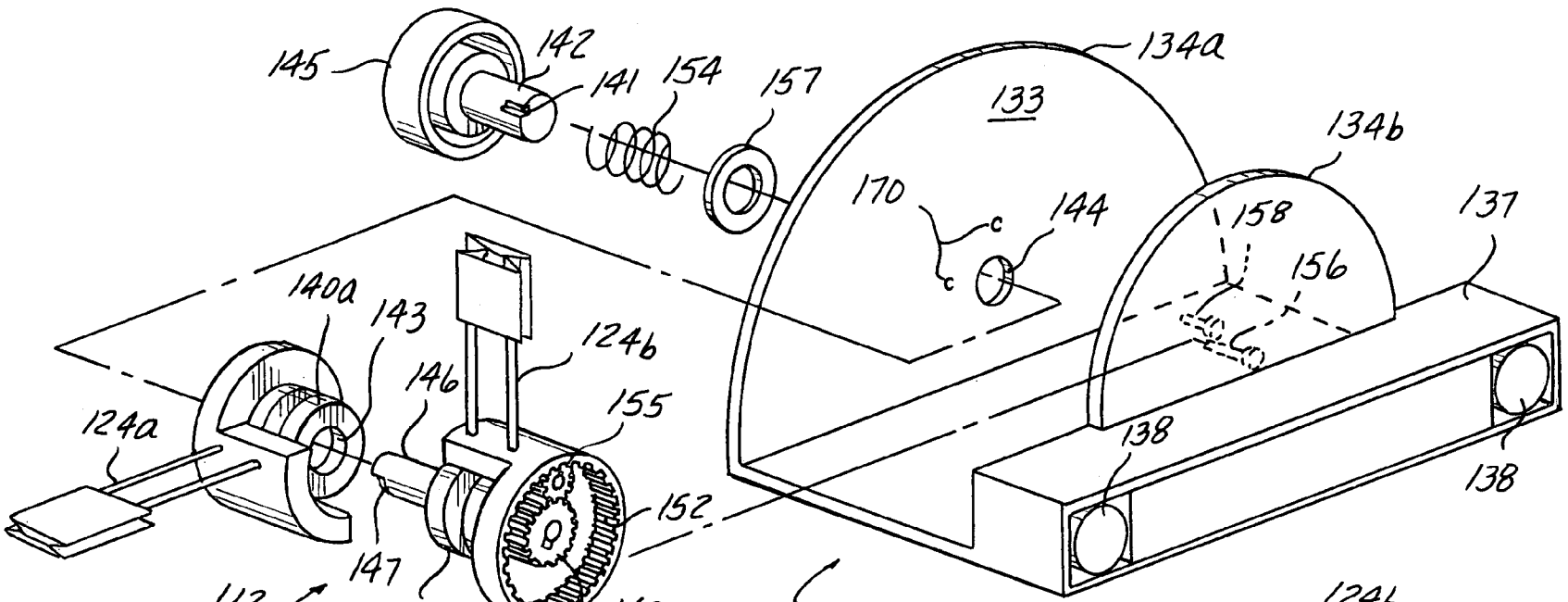
FIG. 9 is an exploded view of alignment means and actuating means for the window shade of the second embodiment.

The second embodiment of an apparatus for a shade also includes alignment means and actuating means as shown in FIGS. 7–11. The actuating means of the second embodiment provides a single knob 145 to extend and retract the shade 10. The actuating means provides a means for simultaneously extending and retracting each shade with the single knob 145. The second embodiment also includes an alignment means for expanding and retracting the outer radial edges (not shown, but similar to edges 10*a* in FIG. 1) of the shade 110 to eliminate uneven gaps between the shade 110 and the peripheral edge of the window 100*a*. Similar to the first embodiment, the second embodiment also includes dual shades 110 which have arcuate portions defining a radius substantially equal to less than a the radius defined by the arched window frame. The second embodiment uses a gear and hinge device 112 to acuate and simultaneously move each linear retractable arm 124*a*, 124*b* relative to the linear rail 120. Centrally located on the linear rail 120 is the actuating means for securing to a metal door or window frame and alignment means for expanding and retracting certain edges of the shade to eliminate uneven gapping. FIG. 9 shows an exploded view of the features incorporated in the second embodiment of the invention. A bracket 122 is formed having cover panels 134*a*, 134*b* forming two flanges of the bracket 122. An arcuate rail 136, as shown in FIG. 7, can be inserted between the cover panels 134*a*, 134*b*. Cover panel 134*b* is positioned on a base rail 137 of the bracket 122. The base rail 137 may include means for magnetically attaching the apparatus to a steel or other metal door or frame. The bracket 122 is either connected to the linear rail 120 by means of bolts 119 or molded as one piece. The bracket 122 is centrally located along the axial length of the linear rod 120. The means for attaching may include at least one magnet 138 attached to an exterior edge of the base rail 137. The cover panels 134*a*, 134*b* are spaced from each other at a predetermined distance for receiving the linear rail 120 therebetween. A window shade 110 is centrally positioned thereon along with the actuating means for extending and retracting the dual window shades 110, simultaneously. The arcuate rail 136 provides an alignment means for the shade 110 to eliminate or minimize gaps between the outer radial shade edge and the periphery of the window.

The gear and hinge device 112 of the actuating means includes a pair of hinge components 140*a*, 140*b*. A rotatable arm 124*a* is secured to hinge component 140*a* and extends outwardly therefrom. A rotatable arm 124*b* is secured to hinge component 140*b* and extends outwardly therefrom. The arcuate rail 136 is inserted between the rotatable arms 124*a*, 124*b*. The hinge components 140*a*, 140*b* interlock with each other to form a hinge to allow rotatable arms 124*a*, 124*b* to rotate relative to each other. The knob 145 has a forward pin 142 for positioning through aperture 144 centrally located in cover panel 134 and through aperture 143 for selective connection with hinge component 140*b*. Forward pin 142 has a tab 141. Hinge 140*b* also includes a forward pin 146 having a notch 147 therein for proper alignment to pin 142 so that tab 141 sets within notch 147.

Figure 10:
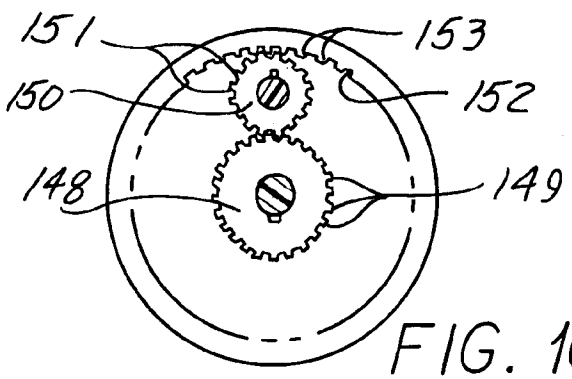
FIG. 10 is a gear mechanism for the actuating means of the second embodiment.

A planetary gear system is provided to actuate rotatable arm 124*b* when the rotatable arm 124*a* is rotated. As seen in FIG. 9, integral housing 155 at one end of hinge component 140*b* forms the driven gear 152 of the gear system. Pin 146 formed in hinge component 140*b* is integrally connected to a concentric gear 148 having a peripheral surface with teeth 149. The planetary gearing includes the concentric gear 148 communicating and moving with pin 146, a follower gear 150 having teeth 151 mesh with teeth 149 of gear 148 and also with teeth 153 of the driven gear 152. The movement of pin 146 results in the movement of rotatable arm 124*b* through the planetary gearing and rotatable arm 124*a* in opposite directions. As can be seen in FIG. 10, the teeth 153 on the driven gear 152 may only encompass a portion of the inner peripheral edge of the housing 155 since the rotatable arms 124*a*, 124*b* each travel only approximately 90°.

Figure 11:
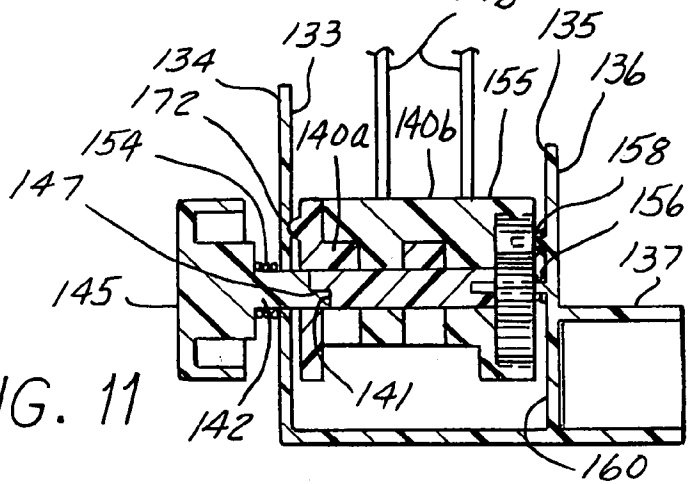
FIG. 11 is a cross-sectional view of a portion of the actuating means of the second embodiment.

The slot 147 and tab 141 connection between pins 146 and 142, respectively, prevents slipping between the connection of pin 142 and 146 and thereby prevent slipping between first and second hinge components 140*a* and 140*b* as the knob 145 is being turned to extend and retract the dual shades 110 simultaneously. The binge components 140*a*, 140*b* mesh with each other as seen in FIG. 11. The gear and hinge device 112 provide a means for actuating the dual shades simultaneously to move the rotatable arms 124*a*, 124*b* in opposite directions.

Further, as shown in FIG. 11, pins 156 and 158 are secured into the inner face of the cover panel 134*b*. The pins 156 and 158 maintain the constant orientation of gears 148 and 150, respectively, to each other. A gap 160 is provided between the gearing mechanism and the inner face 135 of the cover panel 134*b* to allow the turning mechanism to slide for and aft along pins 156 and 158.

As in the first embodiment, the arcuate rail 136 provides an alignment means for the window shade 110. The linear rotatable arms 124*a*, 124*b* are slipped into the upper linear edges 110*d* of the shade 110. As shown in FIGS. 7 and 8, the rotatable arms may be inserted into one of the uppermost honeycomb layers of the shade 110. A lightweight stiffening material 113 may be inserted on the rotatable arms 124*a*, 124*b* and into the uppermost honeycombs 110 extending the length of the upper linear edges 110*a* to provide protection to the shade 110 material as the shade 110 is being extended and retracted. The rotatable arms 124*a*, 124*b* are each formed by a pair of prongs that extend on each side of the arcuate rail 136. However, other linear configurations are possible maintaining the lightweight nature of the shade 110. The arcuate rail 136 acts as a stop for the lower arcuate edge 110*c* of the shade. The stop/arcuate rail 136 also aligns the shade 110 to conform to the shape of the window to eliminate gaps. The stop/arcuate rail 136 prevents the shade 10 from falling via gravity against the gear and hinge device 112 of the actuating means so that the shade 110 can conform to the window shape when extended or closed. An arched window using the benefits of the present invention can have other arcuate configurations, such as the eyebrow arch configuration shown in FIG. 8. The arcuate rail 136*a* can be configured to accommodate other arcuate designs. The arcuate rail 136 or 136*a* can be selectively inserted into the apparatus of the second embodiment.

The second embodiment also provides a means for limiting the extension of the shade. A spring 154 and washer 157 provides biasing means for holding the shades 110 open in various positions. The spring 154 biases the knob 145 and pin 142 to be spaced from pins 156 and 158 and when the knob 145 is depressed, the spring 154 reacts so that pin 142 communicates with pins 156, 158. The limiting means further includes a plurality of notches 170 at predetermined locations in the interior face 133 of the cover panel 134. The limiting means also includes a protuberance 172 sized and positioned on the hinge component 140*a* to set into one of the notches 170. The shade is held in position when the protuberance 172 is located in one of the notches 170. The notches are positioned to allow for various degrees of extension of the shade 110. When the knob 145 is depressed, the shade can freely move to another one of the notches 170.

A third embodiment of the invention is shown in FIGS. 12–17. This embodiment shows an apparatus for a single shade 210 having an arcuate path of 180°. The apparatus for the shade 210 includes an actuating means and an alignment means. The apparatus of the third embodiment includes a linear rail 220 having the actuating means and the alignment means centrally located in the linear rail 220. A pair of cover panels 234 are connected to each exterior edge of the linear rail 220 to conceal the actuation means and alignment means for the shade 210. The cover panels 234 are secured to the linear rail 220 by means of bolts 232 extending through the cover panels 234 and linear rail 220.

The actuating means includes a spring 259 actuated knob 245 secured to a roller member 224 via threaded pin 243. The roller member 224 extends laterally between the two cover panels 234 and attached thereto. The attachment of the roller 224 to the knob 245 is in such a way that the roller member 224 rotates with the rotation of the knob 245. Secured to the roller member is a rotatable linear member 240 secured to an upper exposed edge of the window shade 210. The rotatable linear member 240 may be attached to the upper linear edge 210*d* of the window shade 210 by insertion into an upper honeycombed configuration of the shade 210. For large windows, a linear member, similarly as shown at 50 in FIG. 3, may also be inserted into the upper honeycomb cell 11. The exposed end 240*a* of the rotatable linear member 240 is preferably attached to the roller member 224 at an upper portion of the roller member 224. The connection of the rotatable linear member 240 to the roller member allows for the rotation of the knob 245 to move the rotatable linear member 240 to open and close the shade 210.

Figure 13:
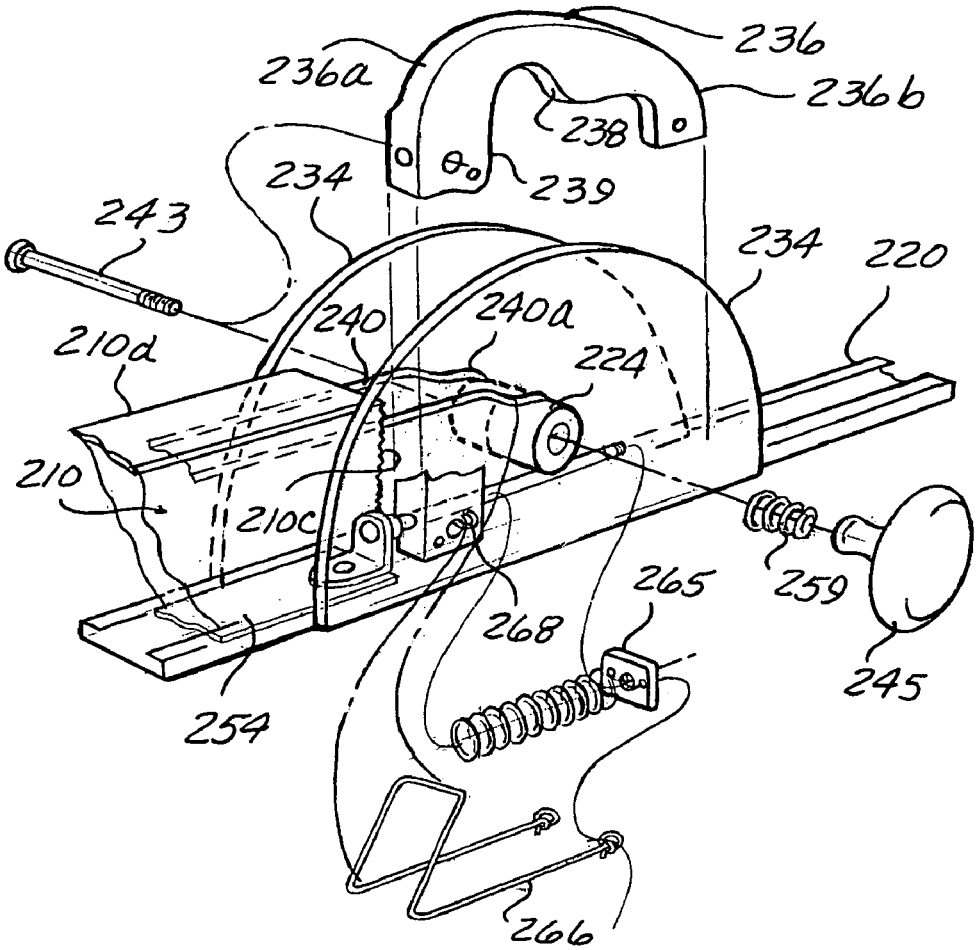
FIG. 13 is an exploded view of certain features of an actuating means and alignment means of the present invention.
Figure 14:
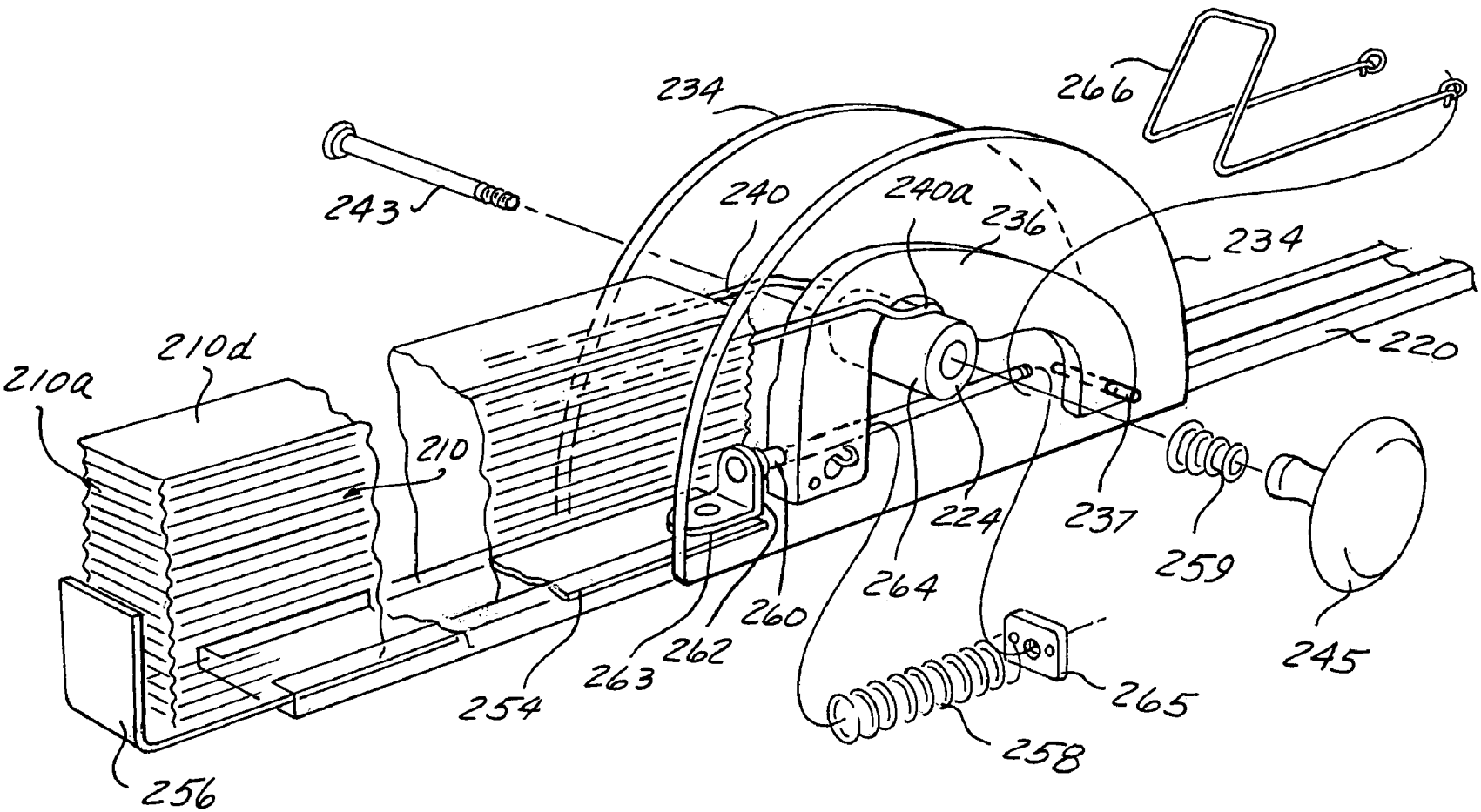
FIG. 14 is an exploded view showing other features of the alignment means.
Figure 15:
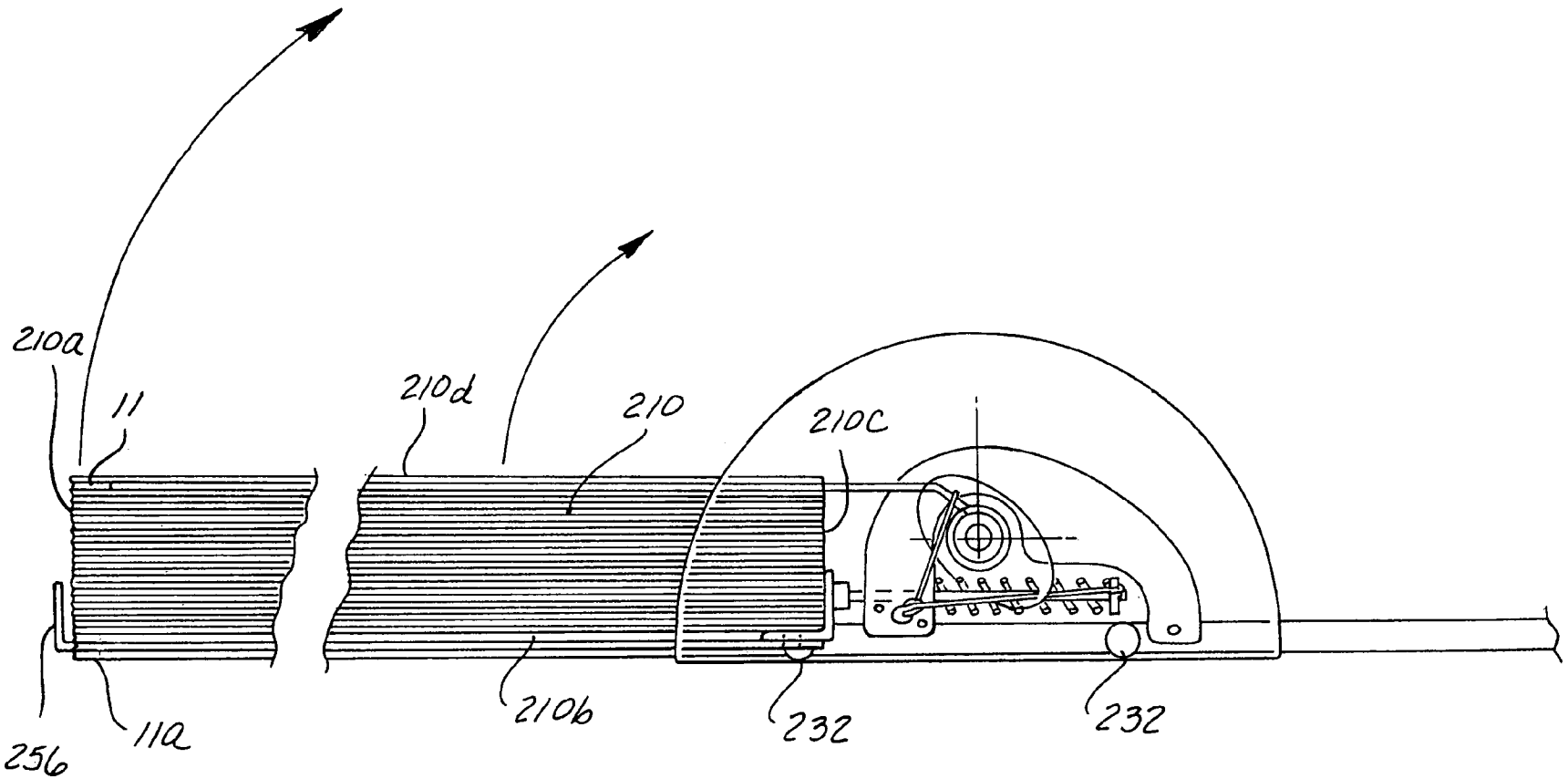
FIG. 15 is an elevational view showing the shade in the fully retracted position.
Figure 16:
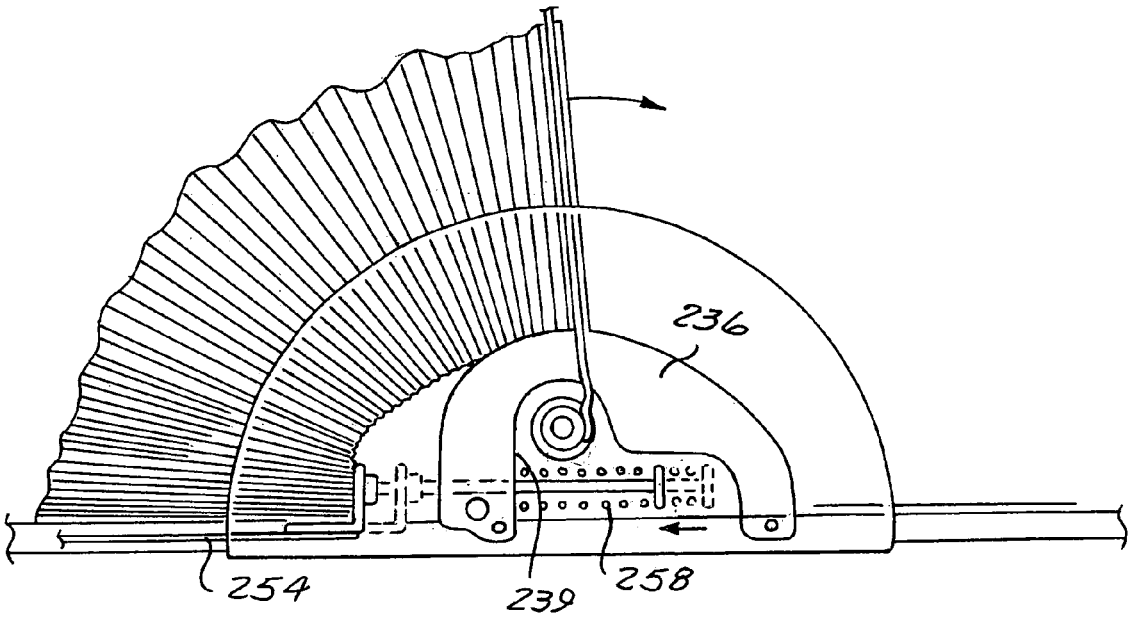
FIG. 16 is an elevational view showing a portion of the shade partially extended.
Figure 17:
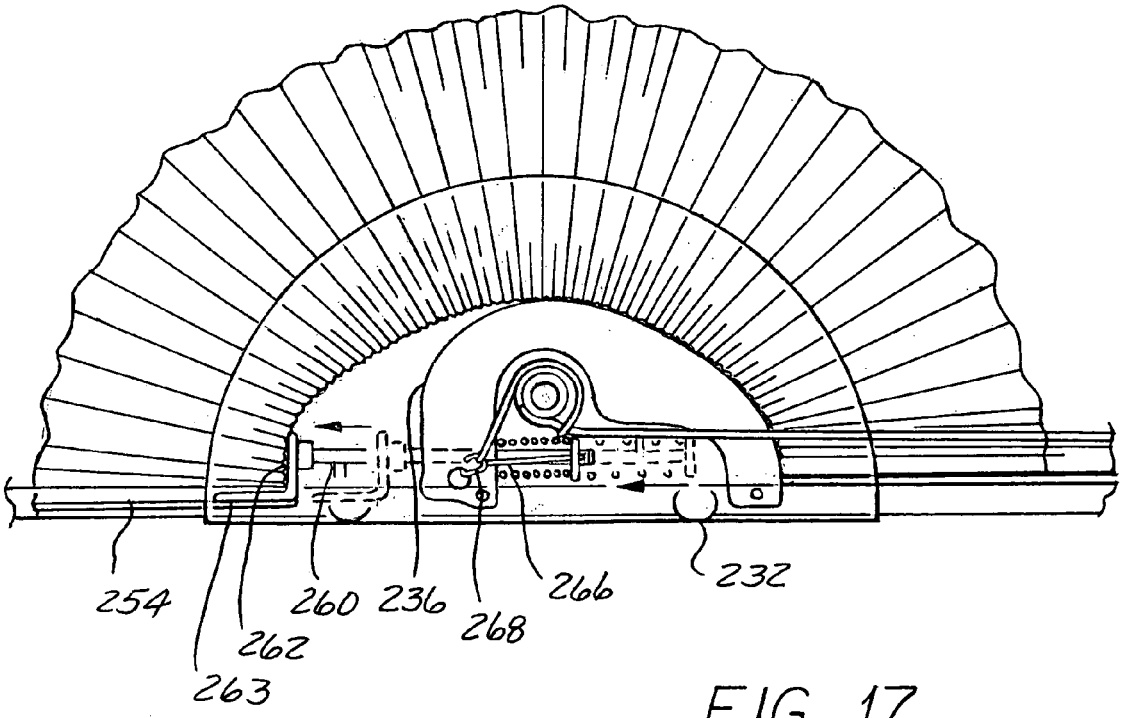
FIG. 17 is an elevational view showing a portion of the shade in a extended position.

An alignment means is provided to align the outer arcuate edge 210*a* of the window shade 210 with the frame of the window; and to eliminate gaps between the peripheral edge 210*a* of the window shade 210 and the window frame 100 or outer periphery of the window. One feature of the alignment means is an arcuate rail 236. The arcuate rail 236 is held within the linear rail 220 by pins 237. The arcuate rail 236 provides a path for movement of the lower arcuate edge 210*c* of the window shade 210. As can be seen in FIGS. 13–14, the rotatable linear member 240 consists of a pair of prongs that are positioned on each side of the arcuate rail 236 so that the lower shade surface 210*c* rides on the arcuate rail 236. The arcuate rail 236 has a lower surface providing a cutout area 238 for disposition of the roller member 224 and other elements of the alignment means. During the extending of a conventional arcuate shade, gravity forces the lower arcuate edge 210*c* of the shade 210 to fall against the rotation mechanism. In the present invention, the arcuate rail 236 provides a path for the lower arcuate edge 210*c* of the shade 210 and forces the shade outer arcuate edge 210*a* to push out and meet the peripheral edge of the window or window frame 100. In an embodiment where the shade 210 travels 180°, the arcuate rail 236 is preferably asymmetrical as shown in FIGS. 12–17. The slope 236*a* of the arcuate rail adjacent to the window shade in the retracted position has a steeper and more vertical slope. The slope 236*b* of the arcuate rail 236 has a less vertical slope than the path at 236*a* and generally follows the arcuate form of the window 100. The more vertical slope 236*a* allows the inside or lower arcuate edge 210*c* of the shade 210 to fall by means of gravity against or nearer to the arcuate rail 236 as the window shade 210 is initially being extended or closed. This is shown in FIG. 16. Gravitational force on the window shade 210 as it is initially being extended allows the leading portion (adjacent edge 210*a*) of the window shade to be maintained within the window frame and to prevent over extension of the shade 210 at the area indicated at 100*b* in FIG. 12.

The alignment means also may include a linear guide 254 that reciprocably moves the lower linear edge 210*b* and proximate portions of the window shade 210 to and from the peripheral edge of the window frame 1 as the window shade 210 is being extended or retracted. The linear guide 254 has a vertical extending edge 256 positioned adjacent the exterior arcuate edge 210*a* of the window shade 210 for the purpose of retracting the shade 210 inward. The movement of the linear guide 254 is actuated by a spring-loaded plunger 260. The spring-loaded plunger 260 includes a leading edge 262 having an integral tab 263 connected to the linear guide 254. At the opposing end of the leading edge 262 of the plunger 260 is a pin 264 that extends through an aperture in the arcuate rail 236 to extend into the cutout are 238 formed in the lower surface of the arcuate rail 236. A spring 258 is located on the pin 264 and held in place between a bolt 265 secured to one end of the pin 264 and an inner wall 239 of the cutout area 238 in the lower surface of the arcuate rail 236. The spring 258 is biased for the shade 210 to be in the retracted or open position. The movement of the knob 245 to close the shade 210 communicates with the spring-loaded plunger 260 by means of a flexible member 266. As seen in FIG. 13, the flexible member 266 is wound across the rotatable linear member 240 adjacent to the connection of the rotatable linear member 240 to the roller member 224. Each end of the flexible member 266 is guided through a guide screw 268 on opposing sides of the arcuate member 236 and extending for securement to the end screw 265. Therefore, the movement of the rotatable linear member 240 rotates the flexible member 266 and thereby moves the spring 258 toward wall 239. As the spring 258 and pin 264 move toward the wall 239, the leading edge 262 of the plunger 260 pushes the inside arcuate edge 210*c* of the shade 210 outward toward the window frame 1. Although the spring 258 biases the window shade 210 to an extended position, when the window shade 210 has been partially extended to approximately the peak of the arcuate rail 236, the weight of the rotatable linear member 240 along with the weight of the window shade 210 overcomes the tension on the spring 258 to maintain the window shade 210 at a fixed partially extended position. As the window shade 210 is being retracted, the rotatable linear member 240 rotates and moves the flexible cord 266 which also allows the pin 264 and spring 258 to move against the resistance so that the plunger 260 retracts. Since the plunger 260 is connected to the linear guide 254, the vertical extending edge 256 of the slidable member 254 pushes the outer arcuate edge 210*a* of the window shade 210 back toward the actuation mechanism.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law. One such modification would include the use of a remote control and motorized mechanism to actuate the apparatus of the present invention.

What is claimed is:

1. An apparatus for positioning an arcuate shade along an arcuate path of a window, the arcuate shade having at least one inner and outer arcuate edge and at least one upper and lower linear edge, the apparatus comprising:

a member engageable with the shade;

actuation means for moving the member along the arcuate path; and alignment means for expanding and retracting at least certain edges of the shade for eliminating uneven gapping between the shade and the arcuate path of the window wherein the alignment means includes an arcuate rail for guiding the at least one inner arcuate edge of the shade as the shade is retracted and extended and eliminating a gap at an upper arcuate portion of the window and the alignment means further includes a slidable linear guide for moving at least one of the lower linear edges of the shade toward an outer arcuate edge of the window.

2. The apparatus of claim 1, wherein the slidable linear guide is activated for movement by the actuation means.

3. The apparatus of claim 1, wherein the slidable linear guide extends and retracts at least one linear edge of the shade.

4. The apparatus of claim 1, wherein the actuation member includes a knob communicating with a roller, wherein one end of the member is secured to an outer surface of the roller.

5. The apparatus of claim 4, further comprising a flexible member and a spring loaded plunger, wherein the flexible member communicates rotating movement of the roller to the spring loaded plunger.

6. The apparatus of claim 5, wherein the spring loaded plunger reciprocally moves the slidable linear guide.

7. The apparatus of claim 6 wherein the member includes a pair of spaced prongs attached to one edge of the shade and wherein the arcuate rail is disposed between the pair of prongs.

8. The apparatus of claim 7, wherein the arcuate rail is asymmetrical having a first slope adjacent the plunger with a more vertical slope than the second slope spaced from the plunger.

9. An apparatus for positioning an arcuate shade along an arcuate path of a window, the arcuate shade having at least one inner and outer arcuate edge and at least one upper and lower linear edge, the apparatus comprising:

a member engageable with the shade;

actuation means for moving the member along the arcuate path; and alignment means for expanding and retracting at least certain edges of the shade for eliminating uneven gapping between the shade and the arcuate path of the window wherein the alignment means includes an arcuate rail for guiding the at least one inner arcuate edge of the shade as the shade is retracted and extended and eliminating a gap at an upper arcuate portion of the window and the alignment means further includes a slidable linear guide for moving at least one of the lower linear edges of the shade toward an outer arcuate edge of the window, wherein the alignment means includes a spring-loaded plunger structure that moves the slidable linear guide.

10. The apparatus of claim 9, wherein the arcuate rail is symmetrical.

11. The apparatus of claim 9, wherein the arcuate rail is asymmetrical.

12. The apparatus of claim 9, wherein the slidable linear guide extends and retracts at least one linear edge of the shade.

13. The apparatus of claim 9 wherein the alignment means includes an arcuate rail, and the actuation means moves the member relative to the arcuate rail for guiding the at least one inner arcuate edge over the arcuate rail.

14. The apparatus of claim 13, wherein the linear rail has a pair of members rotatable relative to the linear rail, and further comprising means for rotating the pair of members simultaneously.

15. The apparatus of claim 14, wherein the actuation means includes a cord communicating with the pair of members for simultaneous rotation when tension is applied or released from the cord.

16. The apparatus of claim 15, wherein the alignment means further includes a linear guide engageable with an edge of the shade and wherein said cord communicates with the linear guide to slide said linear guide relative to the linear rail when tension is applied or released from the cord.

17. The apparatus of claim 16, further comprising a bracket for connecting the arcuate rail to the linear rail.

18. The apparatus of claim 16, further comprising a spring, wherein a first end of the spring is connected to the cord, and a second end of the spring is connected to a first pair of cord segments, one of the first pair of cord segments is connected to one of the pair of members and a second of the first pair of cord segments is connected to the other of the pair of members.

19. The apparatus of claim 18, further comprising a second pair of cord segments each having an end connected to the first end of the spring and each having a second end connected to the linear guide.

20. The apparatus of claim 16, wherein the linear guide has a vertical extending edge at each end and wherein the shade is disposed between the vertical extending edges.

21. The apparatus of claim 16 comprising a spring means communicating with a cord, said spring means providing means for maintaining the shade in a closed position and providing means for linearly extending the lower linear edges of the shade toward the outer arcuate edge of the window.

22. The apparatus of claim 13, wherein the member has a cuff at one end for moving over the arcuate rail.

23. The apparatus of claim 9, further comprising means for mounting said apparatus on a metal structure.

24. The apparatus of claim 23, further comprising limiting means for limiting the extension of the shade, wherein the limiting means includes a protuberance extending from the first hinge component for disposal in one of a plurality of notches at predetermined locations in the cover plate.

25. The apparatus of claim 9, wherein the arcuate rail has a semicircular configuration.

26. The apparatus of claim 9, wherein the arcuate rail has an eyebrow configuration.

27. An apparatus for positioning an arcuate shade along an arcuate path of a window, the arcuate shade having at least one inner and outer arcuate edge and at least one upper and lower linear edge, the apparatus comprising:

a member engageable with the shade;

actuation means for moving the member along the arcuate path; and alignment means for expanding and retracting at least certain edges of the shade for eliminating uneven gapping between the shade and the arcuate path of the window wherein the alignment means includes an arcuate rail for at least guiding the at least one inner arcuate edge over the arcuate rail, and wherein the actuation means is secured to a linear rail and centrally located on the linear rail, wherein the linear rail has a pair of members rotatable relative to the linear rail, and further comprising means for rotating the pair of members simultaneously, wherein the actuation means includes a knob communicating with a gear and hinge device for rotating the pair of members in the opposite direction from each other.

28. The apparatus of claim 27, wherein the gear and hinge device includes a first hinge component and a second hinge component meshed together, and wherein said first hinge component is secured to one member and the second hinge component secured to the other member.

29. The apparatus of claim 28, wherein the second hinge component houses a planetary gear system.

30. The apparatus of claim 29, wherein the knob communicates with the planetary gear system via interconnecting pins for rotating the pair of members simultaneously.

31. The apparatus of claim 27, wherein the gear and hinge device is disposed between a pair of cover plates.

32. An apparatus for positioning an arcuate shade along an arcuate path of a window, the arcuate shade having at least one inner and outer arcuate edge and at least one upper and lower linear edge, the apparatus comprising:

a member engageable with the shade;

actuation means for moving the member along the arcuate path; and alignment means for expanding and retracting at least certain edges of the shade for eliminating uneven gapping between the shade and the arcuate path of the window wherein the alignment means includes an arcuate rail for at least guiding the at least one inner arcuate edge over the arcuate rail, and wherein the actuation means is secured to a linear rail and centrally located on the linear rail, wherein the linear rail has a pair of members rotatable relative to the linear rail, and further comprising means for rotating the pair of members simultaneously wherein the actuating means includes a cord and further comprising leverage means for rotating the pair of member via the cord.

33. The apparatus of claim 32, wherein the leverage means includes a pair of pins positioned at predetermined locations relative to the rotatable members.

* * * * *